US011591948B2

(12) United States Patent
Laugwitz et al.

(10) Patent No.: US 11,591,948 B2
(45) Date of Patent: Feb. 28, 2023

(54) VIBRATING PLATE WITH HOOD OPTIMIZED FOR NOISE REDUCTION

(71) Applicant: BOMAG GMBH, Boppard (DE)

(72) Inventors: Niels Laugwitz, Boppard (DE); Josef Becker, Boppard (DE)

(73) Assignee: BOMAG GMBH, Boppard (DE)

( * ) Notice: Subject to any disclaimer, the term of this patent is extended or adjusted under 35 U.S.C. 154(b) by 0 days.

(21) Appl. No.: 17/301,399

(22) Filed: Apr. 1, 2021

(65) Prior Publication Data

US 2021/0310398 A1 Oct. 7, 2021

(30) Foreign Application Priority Data

Apr. 3, 2020 (DE) ..... 10 2020 002 160.3

(51) Int. Cl.
*F01N 13/00* (2010.01)
*E01C 19/38* (2006.01)
(Continued)

(52) U.S. Cl.
CPC ..... *F01N 13/002* (2013.01); *E01C 19/38* (2013.01); *E02D 3/074* (2013.01); *F01P 1/06* (2013.01); *F01N 2590/06* (2013.01)

(58) Field of Classification Search
CPC ..... F01N 13/002; F01N 2590/06; F01P 1/06
See application file for complete search history.

(56) References Cited

U.S. PATENT DOCUMENTS 4,747,467 A * 5/1988 Lyon ..... F02C 7/24 181/220
5,594,216 A * 1/1997 Yasukawa ..... F02C 7/045 181/294

(Continued)

FOREIGN PATENT DOCUMENTS

DE 29920177 2/2000
DE 102009017209 11/2010

(Continued)

OTHER PUBLICATIONS

DE29920177U1 Bomag Nov. 1999 (Year: 1999).*
English translation of an Office Action from related Japanese Appln. No. 2021-063542, dated Jul. 21, 2022.

*Primary Examiner* — Carl C Staubach
(74) *Attorney, Agent, or Firm* — Grossman, Tucker, Perreault & Pfleger PLLC; Michael J. Gallagher

(57) ABSTRACT

The invention relates to a vibrating plate for ground compaction, comprising a drive motor, an exciter unit which is driven by the drive motor and by means of which a base plate can be set in vibration, an adjustably mounted hood, which can be adjusted between an operating position at least partially covering the drive motor and a maintenance position at least partially exposing the drive motor, an exhaust air guiding device leading from the drive motor to an exhaust air opening in the hood for the cooling air of the drive motor, the exhaust air guiding device being formed in two parts and comprising an exhaust air adapter on the drive motor side and an exhaust air guide on the hood side, the exhaust air adapter and the exhaust air guide together forming a continuous exhaust air path from the drive motor to the exhaust air opening in the hood when the hood is in the operating position, the exhaust air adapter being attached to the drive motor, and the exhaust air guide being attached to the hood such that it is adjustable with the hood between the operating position and the maintenance position.

20 Claims, 7 Drawing Sheets

(51) Int. Cl.
*E02D 3/074* (2006.01)
*F01P 1/06* (2006.01)

(56) References Cited

U.S. PATENT DOCUMENTS

| | | | | |
|---|---|---|---|---|
| 6,302,749 | B1 * | 10/2001 | Tawa | F02M 35/10249 440/76 |
| 6,659,685 | B1 * | 12/2003 | Persson | E01C 19/38 404/133.05 |
| 9,593,453 | B2 * | 3/2017 | Halimi | F16C 3/22 |
| 2011/0091279 | A1 * | 4/2011 | Kuerten | E02D 3/046 404/133.1 |
| 2013/0187375 | A1 * | 7/2013 | Hebisch | F01N 13/16 285/49 |
| 2013/0279980 | A1 * | 10/2013 | Steffen | E02D 3/068 404/133.05 |
| 2019/0234028 | A1 | 8/2019 | Laugwitz et al. | |

FOREIGN PATENT DOCUMENTS

| | | |
|---|---|---|
| DE | 102012017777 | 3/2014 |
| DE | 202016005059 | 10/2016 |
| EP | 1024227 | 8/2000 |
| EP | 3491193 | 5/2020 |
| JP | S4951909 | 5/1974 |
| JP | S4996404 | 8/1974 |
| JP | S5112035 | 1/1976 |
| JP | S559801 | 1/1980 |
| JP | 2000089766 | 3/2000 |
| JP | 3073000 | 8/2000 |

* cited by examiner

Prior Art

VIBRATING PLATE WITH HOOD OPTIMIZED FOR NOISE REDUCTION

FIELD

The present invention relates to a vibrating plate for ground compaction.

BACKGROUND

Generic vibrating plates, plate vibrators or vibratory plates are known, for example, from the DE 10 2012 017 777 A1, DE 20 2016 005 059 U1 and EP 3 491 193 A1 by the same applicant. These are hand-held or remote-controlled machines used to compact ground materials, such as asphalt, sand, gravel or soil. They typically include a drive motor, such as an internal combustion engine that runs on gasoline, diesel, or natural gas. Single-cylinder engines are common, for example. Alternatively, electric motors may also be used. The drive motor is used, for example, to drive an exciter unit. The latter typically comprises at least one imbalance mass that is rotated by the drive motor. This may be done, for example, with the interposition of a suitable gearbox. The actual contact with the ground is made with the help of a base plate. The exciter unit may be mounted on the base plate. A support plate or machine frame that carries the drive motor may be connected to the base plate, usually via suitable buffer elements. A guide element, such as a guide drawbar or guide bracket, may be articulated to the support plate. The base plate or ground contact plate of the vibrating plate can be set in vibration with the help of the exciter unit. In other words, the base plate is subjected to dynamic forces during operation of the vibrating plate, resulting in compaction of the underlying ground. The maximum amplitudes of the resulting oscillating motion may be directional and adjustable, for example, to achieve self-propulsion of the vibrating plate.

Especially in the case of large and heavy vibrating plates, the drive motor generates a considerable noise level. For this reason, it is known to equip the vibrating plates with an engine hood, hereinafter also simply called hood. However, since the drive motor must be regularly accessible for maintenance purposes, the hood is normally mounted on the machine frame of the vibrating plate in an adjustable manner. The hood is adjustable, for example, between an operating position covering the drive motor at least partially and in particular substantially to the top and to at least several of the sides, and a maintenance position exposing the drive motor at least partially, in particular to the top and to at least one of the sides. This includes, for example, both linear displacement and swiveling of the hood. The fact that the hood is adjustably mounted also includes, for example, the case where the hood is detachably connected to the machine frame of the vibrating plate, for example via threaded connections. For example, to adjust the hood between the operating position and the maintenance position, it may be necessary to loosen one or more threaded connections. The threaded connections can be restored after the maintenance work. On the other hand, fastening the hood to the machine frame of the vibrating plate via connections that must be destroyed in order to adjust the hood is not included herein and is not considered to be "adjustable mounting" of the hood.

To cool the drive motor, cooling air is typically actively directed past the drive motor, for example, the cylinder of the drive motor. However, the heated cooling air must then be directed out of the interior of the hood, as otherwise heat builds up under the hood. The generic vibrating plates therefore typically have an exhaust air guiding device leading from the drive motor to an exhaust air opening in the hood for the cooling air of the drive motor. The task of the exhaust air guiding device is to transport the heated cooling air, i.e. the exhaust air, from the drive motor through the interior of the hood in a targeted, spatially delimited and directed manner to the exhaust air opening of the hood, through which the exhaust air can escape to the outside environment. Typically, the exhaust air guiding device comprises a single funnel- or trumpet-shaped molded part which is attached to an exit opening for the exhaust air on the drive motor and extends through the interior of the hood to the exhaust air opening. However, this prior art configuration has several disadvantages. For example, the structure-borne sound of the drive motor is transmitted to the exhaust air guiding device, which emits it through the exhaust air opening to the outside environment (loudspeaker effect). In addition, the exhaust air guiding device cannot be sized arbitrarily, firstly because the available attachment points on the drive motor are not sufficient to support a heavy weight at this point, and secondly because the exhaust air guiding device must not interfere with the adjustment of the hood between the operating and maintenance positions. Due to the small dimensions of the exhaust air guiding device, it is impossible to line it with sound-damping elements, for example, or to use particularly heavy materials for the exhaust air guiding device that would transmit less structure-borne sound. As such, conventional exhaust air guiding devices have so far done little to reduce noise emissions from the vibrating plates.

An exhaust opening is also typically provided in the hood for the exhaust gases from the drive motor, through which the exhaust gases are directed to the outside environment. The exhaust gas is typically routed in the interior of the hood via the exhaust of the drive motor, which extends, for example, up to the exhaust gas opening in the hood. Significant noise emission to the outside environment also occurs in this area of the exhaust gas opening. There is therefore an overall desire to be able to operate vibrating plates more quietly.

SUMMARY

The object of the present invention is to provide a vibrating plate with reduced noise emission. At the same time, handling comfort should not be reduced.

Specifically, in the case of a generic vibrating plate mentioned above, the object is achieved in that the exhaust air guiding device is designed in two parts and comprises an exhaust air adapter on the drive motor side and an exhaust air guide on the hood side, the exhaust air adapter and the exhaust air guide together forming a continuous exhaust air path from the drive motor to the exhaust air opening in the hood when the hood is in the operating position. The exhaust air adapter, on the one hand, is attached to the drive motor and is in particular arranged thereon in a stationary manner. The exhaust air guide, in turn, is attached to the hood in such a way that it can be adjusted with the hood between the operating position and the maintenance position. The arrangement of the exhaust air guide on the hood is thus stationary in particular with respect to the hood. The exhaust air guide may even be integral with the hood and/or an integral part of the hood. In particular, the exhaust air guiding device consists exclusively of the two parts exhaust air adapter and exhaust air guide, which span the entire distance from the drive motor to the exhaust air opening.

Both the exhaust air adapter and the exhaust air guide each represent a duct section conducting or guiding the exhaust air flow. The two duct sections merge in the operating position. The duct sections each have an inlet and an outlet for the exhaust air. The exhaust air coming from the drive motor enters the exhaust air adapter via the inlet of the exhaust air adapter. The outlet of the exhaust air adapter, in turn, is arranged in such a way that, in the operating position of the hood, it rests against the inlet of the exhaust air guide or at least opens into the inlet of the exhaust air guide, so that the exhaust air coming from the exhaust air adapter enters the exhaust air guide through the inlet of the latter. The exhaust air is then routed through the exhaust air guide on the hood side to its outlet, which is located at the hood's exhaust air opening through which the exhaust air can eventually escape to the outside environment. The exhaust air opening of the hood is explicitly not part of the exhaust air guiding device and also not part of the exhaust air guide. The exhaust air guiding device is designed to be as airtight as possible, so that the exhaust air flow is directed essentially completely from the drive motor to the exhaust air opening without escaping into the interior of the hood outside the exhaust air guiding device when the hood is in the operating position. Together, the exhaust air adapter and the exhaust air guide form the, in particular complete, exhaust air path for the exhaust air coming from the drive motor. When the hood is adjusted to the maintenance position, the exhaust air path is separated or opened as the exhaust air adapter and the exhaust air guide are moved away from each other. Additional steps are not required, so overall handling comfort is not reduced. The exhaust air path is closed again when the hood is moved to the operating position. A basic idea of the present invention now is that that a significantly smaller part of the exhaust air guiding device is attached to the drive motor than previously shown in the prior art. This smaller part is formed by the exhaust air adapter. On the other hand, an essential part of the exhaust air guiding device, in particular the larger part, is attached to the hood and can be adjusted together with it. This part is formed by the exhaust air guide. Thus, the invention is aimed at a further development of the hood of the vibrating plate, wherein the hood is designed in such a way that the overall noise emission of the vibrating plate is reduced. The hood can support a significantly higher weight, so that the exhaust air guide on the hood side can be equipped with sound-damping materials, for example, as will be explained in more detail below. Another advantage consists in the space and installation space saved, since the hood now only has to be adjusted across a smaller internal volume formed by the drive motor and the part of the exhaust air guide on the drive motor side. This comes into play in particular when the hood can be swiveled between the operating position and the maintenance position.

The path that the exhaust air has to travel through the exhaust air guiding device until it escapes into the outside environment at the exhaust air opening of the hood is referred to as air guiding path. The air guiding path thus extends from the drive motor or an inlet opening positioned downstream of the drive motor, in particular mounted directly on the latter, to the exhaust air opening of the hood, namely when the hood is in the operating position. In order to ensure comparability, the path traveled by the transported exhaust air in laminar flow, i.e. without turbulence or other detours, is regarded as the air flow path. However, the air guiding path does not have to run in a straight line and can also run around curves, for example, if the exhaust air guidance device requires the exhaust air to be diverted accordingly. In addition, the path that passes through the center of the clear width or the interior of the exhaust air guiding device is considered. The air guiding path starts at the inlet of the exhaust air adapter and ends at the outlet of the exhaust air guide. Alternatively, the air guiding path can also be measured from the downstream end of the bypassed cylinder of the drive motor in the direction of flow of the exhaust air to the point where the exhaust air passes through the exhaust air opening of the hood. In order to make the most advantageous use of the noise-reducing effect of the invention, which results from the fact that the structure-borne sound of the drive motor is now only transmitted to a smaller proportion of the exhaust air guiding device and therefore radiates less into the external environment, it is preferred that the exhaust air guide makes up as large a proportion of the exhaust air guiding device as possible. Conversely, the proportion of the exhaust air adapter becomes smaller. For example, it is preferred that the exhaust air guide forms a larger proportion of the air guiding path than the exhaust adapter. The exhaust air guide preferably forms at least 30%, preferably at least 50%, more preferably at least 70%, of the total air guiding path through the exhaust air guiding device between the drive motor and the exhaust air opening. In addition to reduced structure-borne sound transmission, a larger proportion of the exhaust air guide also makes it possible to provide sound-damping or sound-absorbing material over a larger part of the exhaust air guiding device, as will be discussed in more detail below.

The exhaust air guiding device further has an internal volume defined by the inner walls of the exhaust air adapter and the exhaust air guide, and by the inlet opening at or near the drive motor and the outlet opening. Additionally or alternatively, it is preferred that at least 10%, in particular at least 20% and more particularly at least 40% of this internal volume is allotted to the exhaust air guide. Optimally, the volume fraction formed by the exhaust air guide is greater than the volume fraction formed by the exhaust air adapter, in particular when the exhaust air guide forms at least 60% of the total internal volume enclosed by the exhaust air guiding device. These specifications preferably refer to the hood in the operating position.

The exhaust air device further has an inner wall surface or duct surface formed by the area of the inner walls of the exhaust air adapter and the exhaust air guide. The exhaust air guiding device is preferably designed in such a way that the area of the exhaust air guide forms at least 20% of the total inner wall surface of the exhaust air guiding device, in particular at least 30%. It is particularly preferred if the inner wall surface of the exhaust air guide is larger than the inner wall surface of the exhaust air adapter, especially if the inner wall surface of the exhaust air guide accounts for at least 60% of the total inner wall surface of the exhaust air guiding device. These specifications preferably refer to the hood in the operating position.

Accordingly, it may be particularly preferred if the volume of the exhaust air guiding device inside the exhaust air guide is larger than the volume of the exhaust air guiding device inside the exhaust air adapter, in particular at least twice as large, preferably at least three times as large, and more preferably at least four times as large. The greater the proportion of the exhaust air guide to the exhaust air guiding device, the more advantageously noise reduction can be brought about with the present invention. The total volume of the exhaust air guiding device herein denotes the sum of the volumes of the exhaust air adapter and the exhaust air guide. These volumes, in turn, refer to the interior spaces enclosed by these components. In particular, the support structure of the exhaust air adapter and the exhaust air guide are considered here, so that any sound-damping or sound-absorbing materials that may be present do not reduce the volume considered. The volumes of the exhaust air adapter and the exhaust air guide end with the respective openings of the inlets and outlets of these components for the exhaust air already described above. If the openings are in a plane, the volume is measured up to this plane. If, on the other hand, the openings have more complex shapes, so that their edges no longer lie in a plane, the surface closing the volume can be assumed to be a surface that results when a virtual plane considered to be flexible is placed over the openings in such a way that it is completely in contact with the edge of the openings. The area spanning the opening should be minimally deformed, i.e. deviate as little as possible from a plane, depending on the shape of the opening.

Due to its design, the exhaust air of the air cooling system of the drive motor can generally exit the drive motor on different sides. Typically, the exhaust air exits from a side of the drive motor that is not the same side on which the exhaust of the drive motor directs the exhaust gases out of the drive motor. In the case of vibrating plates, however, it is preferable for both the exhaust gases and the exhaust air to exit the machine, or the hood, from the front of the machine, i.e., from a side located at the front of the machine in the forward direction. This is because the operator is typically behind the machine. Exhaust gases and the exhaust air should therefore be discharged on the side of the machine opposite the operator. In addition, the sides of the machine that are parallel to the forward direction, commonly the left and right sides of the machine, are unsuitable for discharging gases because vibrating plates are often used in trenches and are therefore brought very close to the sides of vertical obstacles. These would impede the corresponding discharge of exhaust air and exhaust gases. For these reasons, it may be necessary for the exhaust air guiding device to adapt the flow direction of the exhaust air to the structural conditions by means of the shape of the exhaust air path in such a way that the exhaust air exits at the side of the hood lying in the forward direction of the machine. The flow of exhaust air is therefore not guided from the drive motor to the outlet opening of the hood in a purely straight line but around at least one curve, for example. Preferably, this curve is conditioned by the exhaust air guide. In particular, the exhaust air guide on the hood side is configured such that it changes the flow direction of the exhaust air between the drive motor and the exhaust air opening at least once, in particular by essentially 90°. For this purpose, the exhaust air guide has, for example, baffle surfaces that deflect the flow direction of the exhaust air. This further development is also aimed at making the proportion of the exhaust air guide to the exhaust air guiding device as large as possible in order to maximize the noise reduction of the invention.

The exhaust air adapter preferably has a motor side for connection to the drive motor and a connection side for connection to the exhaust air guide. The connection of the motor side of the exhaust air adapter to the drive motor is typically established using fasteners, for example screws or rivets. This connection exists regardless of whether the hood is in the maintenance position or the operating position. The connection of the connection side of the exhaust air adapter to the exhaust air guide of the hood, on the other hand, consists, for example, of the connection side of the exhaust air adapter with the outlet opening for the exhaust air resting against the exhaust air guide, in particular in such a way that the outlet of the exhaust air adapter rests against the inlet of the exhaust air guide. There is preferably no further connection between the exhaust air adapter and the exhaust air guide, for example by snap-in connections or the like. It is preferred that the connection side of the exhaust air adapter and an inlet wall of the exhaust air guide, which will be described in more detail below, are configured complementary to one other in such a way that they closely rest against each other in the operating position of the hood. In order to make this connection as airtight as possible, it is further preferred that the connection side of the exhaust air adapter has a sealing profile or sealing element (for example, an elastomer seal or a brush seal) that rests against the exhaust air guide when the hood is in the operating position. The sealing profile has a sealing lip, for example, which is made of an elastic material, in particular plastic or rubber. Preferably, the connection side of the exhaust air adapter rests with the sealing profile against the exhaust air guide, in particular its inlet wall. This increases the tightness of the exhaust air guiding device and ensures that no heat build-up can occur under the hood due to warm exhaust air escaping from the exhaust air guiding device.

In order to make the connection of the exhaust air adapter to the exhaust air guide mechanically simple and yet particularly tight, the connection side of the exhaust air adapter is preferably tilted relative to a vertical by an angle which is in particular 5° to 15°, preferably 9° to 12°. Such an inclined position, in particular in the specified angular ranges, results in a relative movement of the exhaust air adapter and the exhaust air guide with respect to each other without the risk of the two components becoming wedged together and in a particularly simple mechanical manner when the hood is adjusted between the maintenance position and the operating position. Particularly preferably, the connection side of the exhaust air adapter lies in a plane which is tilted or inclined with respect to the vertical and which is oriented parallel to the forward direction of the vibrating plate.

According to a preferred embodiment, the exhaust air guide has at least one inlet wall and one guiding wall. The inlet wall in turn preferably has a connection opening through which the exhaust air coming from the exhaust air adapter enters the exhaust air guide. Therefore, the connection opening is the inlet of the exhaust air guide. The guiding wall, on the other hand, primarily serves to seal the exhaust air guiding device and to guide the exhaust air flow through the exhaust air guide. The guiding wall is therefore free of passage openings for the exhaust air. It is now particularly preferred that the inlet wall and the guiding wall are configured as separate components that are mounted successively. In particular, the assembly is performed on each other and on the hood, for example by attaching the guiding wall to the hood first and subsequently attaching the inlet wall to the hood and the guiding wall. In this way, the exhaust air guide according to the invention can be manufactured in a particularly simple manner. Moreover, the inlet wall and the guiding wall can act as stiffening elements on the hood, so that the hood can be made simpler overall by dispensing with conventional stiffening elements. The exhaust air guide thus preferably has exactly three structural elements for creating the guiding space, specifically a partial area of the hood, the guiding wall and the inlet wall.

It may further be advantageous that the inner wall of the hood itself, or a region thereof, is part of the exhaust air guide, or thus constitutes a boundary wall of the interior space of the exhaust air guide. In this way, the number of components required can be reduced.

In order to establish as tight a connection as possible between the exhaust air guide and the exhaust air adapter, it is preferred if the inlet wall of the exhaust air guide is tilted or inclined relative to a vertical by an angle which is in particular 5° to 15°, preferably 9° to 12°. In particular, it is the same angle by which the connection side of the exhaust air adapter is tilted with respect to the vertical. This ensures that the exhaust air adapter and the exhaust air guide closely rest against one another in the operating position of the hood and that the hood can be moved between the maintenance position and the operating position without any problems.

A further simplification of the structure of the exhaust air guide is achieved if, according to a preferred embodiment, the guiding wall is arranged substantially at right angles to at least one wall of the hood and is attached to the latter. Such a configuration is particularly quick and easy to produce and therefore cost-effective.

Due to the low cost of manufacture, it is also preferred that the inlet wall and the guiding wall are made from flat blanks by bending. The blanks, in turn, can be obtained, for example, by punching or cutting from plates. For example, the inlet wall and the guiding wall have tabs that are placed against the walls of the hood and connected to them by fasteners, such as screws or rivets. Overall, the components of the exhaust air guide can thus be manufactured particularly easily and cost-effectively.

In addition, it is preferred if the exhaust air guide is made of an inflexible material, in particular the same material as the hood, for example a metal sheet. This applies in particular to the inlet wall and the guiding wall of the exhaust air guide. Metal sheets with an average thickness of 3 mm to 5 mm, for example 4 mm, are usually used for the hood. The exhaust air guide preferably exhibits a comparable inflexibility. In this way, the structure-borne sound of the drive motor causes the exhaust air guide to vibrate only to a very small extent, if at all, and the vibrations can then in turn be emitted into the outside environment as sound waves via the exhaust air opening. In addition, this configuration creates a stable support structure that can be used, for example, to accommodate sound-damping or sound-absorbing material, as will be explained in more detail below.

Since the hood is typically already made of a comparatively inflexible material, as explained above, the exhaust air guide according to the invention can be further simplified in a preferred embodiment by the exhaust air guide being formed on at least one side, preferably on at least two sides, by walls of the hood. The hood is typically in the form of an essentially rectangular box that is open at the bottom. In particular in a case in which the exhaust air guide is arranged in one of the upper corners of the hood, the side walls of the hood may advantageously also be used as walls of the exhaust air guide. "Upper" in the present context refers to the side of the machine facing away from the base plate of the vibrating plate, while "bottom" refers to the side of the machine facing the base plate of the vibrating plate. For example, at least the wall closing the hood to the top and/or one of the side walls of the hood extending parallel to the forward direction of the vibrating plate may also be used to form part of the exhaust air guide. Preferably, both of the two mentioned walls are used to form a respective portion of the exhaust air guide. In contrast, the exhaust air guide is open in the direction of the wall of the hood which closes off the hood to the front in the forward direction of the vibrating plate. With this open side, the exhaust air guide is attached to the wall of the hood lying in the forward direction of the vibrating plate, in such a way that the interior space of the exhaust air guide communicates with the exhaust air opening located in this hood wall and the exhaust air can escape from the hood through the exhaust air guide.

As already indicated, it is also preferred if at least a part of the exhaust air guide has a lining, in particular arranged inside the exhaust air guide, with a sound-damping and/or sound-absorbing material, for example a plastic foam or a non-woven fabric. Since the exhaust air guide according to the invention is larger and more stable in design than that of the prior art and/or is supported by the hood, a relevant amount of such material can be used. Preferably, the entire interior space or the entire inner surface of the exhaust air guide from its inlet for the exhaust air to its outlet for the exhaust air is lined with a sound-damping or sound-absorbing material. The noise emission of the vibrating plate according to the invention is thus considerably reduced in a cost-effective manner. Alternatively or additionally, the exhaust air guide on the hood side may, in an advantageous further development, be at least partially attached to the hood by means of structure-borne sound insulating elements. These elements may comprise, for example, plastic or elastomer materials. In addition, these elements may also be configured to seal the exhaust air guide on the hood side from the rest of the interior space of the hood and, in particular, from the motor, so that no heated exhaust air adversely affects the temperature balance of the motor (under the hood).

As mentioned at the beginning, noise from the exhaust of the drive motor is also introduced into the outside environment. The exhaust in this case describes the entire exhaust system of the drive motor as is customary in the prior art and includes, for example, at least one catalytic converter and at least one muffler. The exhaust typically ends with the so-called tailpipe. In the prior art, for example, it is envisaged that the tailpipe of the exhaust is configured to extend to an exhaust gas opening in the hood, so that the exhaust gas from the exhaust is discharged into the outside environment via the exhaust gas opening. Despite the fact that there is typically at least one muffler in the exhaust system, this means that considerable noise emissions are emitted into the outside environment. In order to also counteract these noise emissions by an additional or alternative further development of the hood according to the invention, the vibrating plate preferably comprises an exhaust gas guiding device from an exhaust of the drive motor to an exhaust gas opening in the hood, and that the hood comprises a damping socket arranged on the hood in such a way that it is adjustable with the hood between the operating position and the maintenance position. The damping socket is attached to the hood, for example, in particular in a stationary manner, and encloses the exhaust gas opening of the hood. The damping socket is configured to route exhaust gas from the exhaust to the exhaust opening, whereby the damping socket in the operating position of the hood at least partially engages around the exhaust of the drive motor or is configured to surround it in a radially spaced manner. The damping socket is configured, for example, as an annular and/or tubular piece and is made, in particular, of an inflexible material, for example a metal sheet and, in particular, the same material the hood is also made of. The damping socket forms part of the exhaust gas guiding device and routes the drive motor exhaust gases from the exhaust to the exhaust opening of the hood. The provision of the damping socket means that the exhaust does not have to be made to extend directly up to the exhaust gas opening of the hood, but can end in the direction of routing at the level of the damping socket, which can further reduce the transmission of structure-borne sound from the drive motor as noise emissions to the outside environment.

A further reduction in noise emission can be achieved if the damping socket is at least partially lined with a sound-damping or sound-absorbing material, for example a plastic foam or a non-woven fabric. Here, too, it is preferred that the entire inner surface or the entire interior space of the damping socket is lined with such a material.

BRIEF DESCRIPTION OF THE DRAWINGS

The invention will be explained in more detail below by reference to the embodiment examples shown in the figures. In the schematic figures.

DETAILED DESCRIPTION

Figure 1:
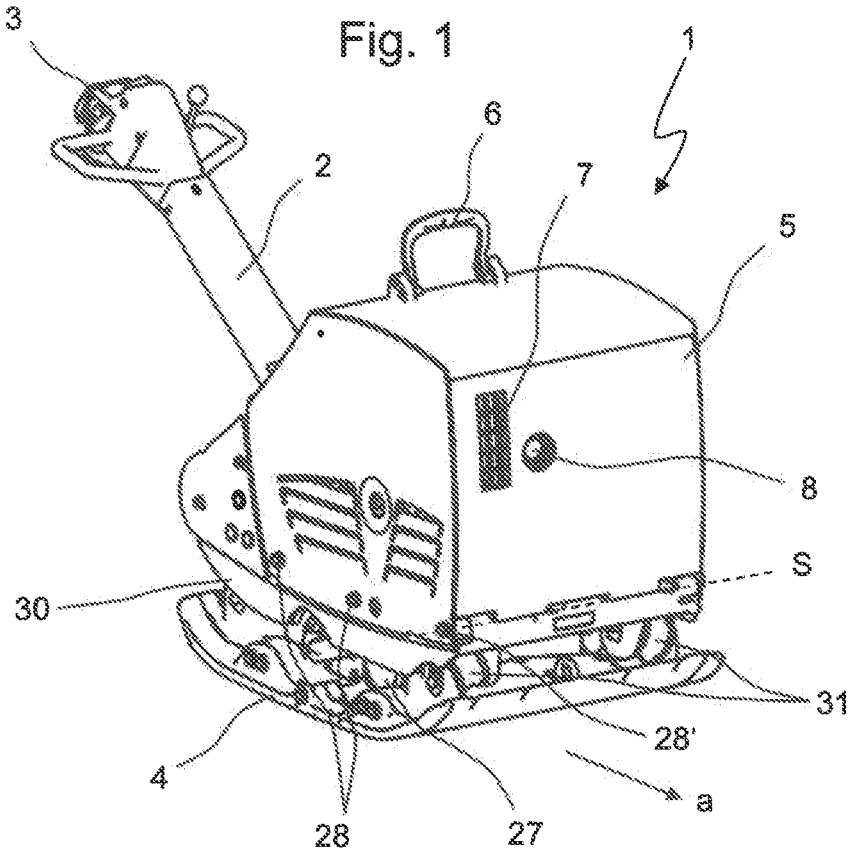
FIG. 1: is an oblique perspective front view of a vibrating plate.

Like parts, or parts acting in a like manner, are designated by like reference numerals. Recurring parts are not designated separately in each figure.

Figure 2:
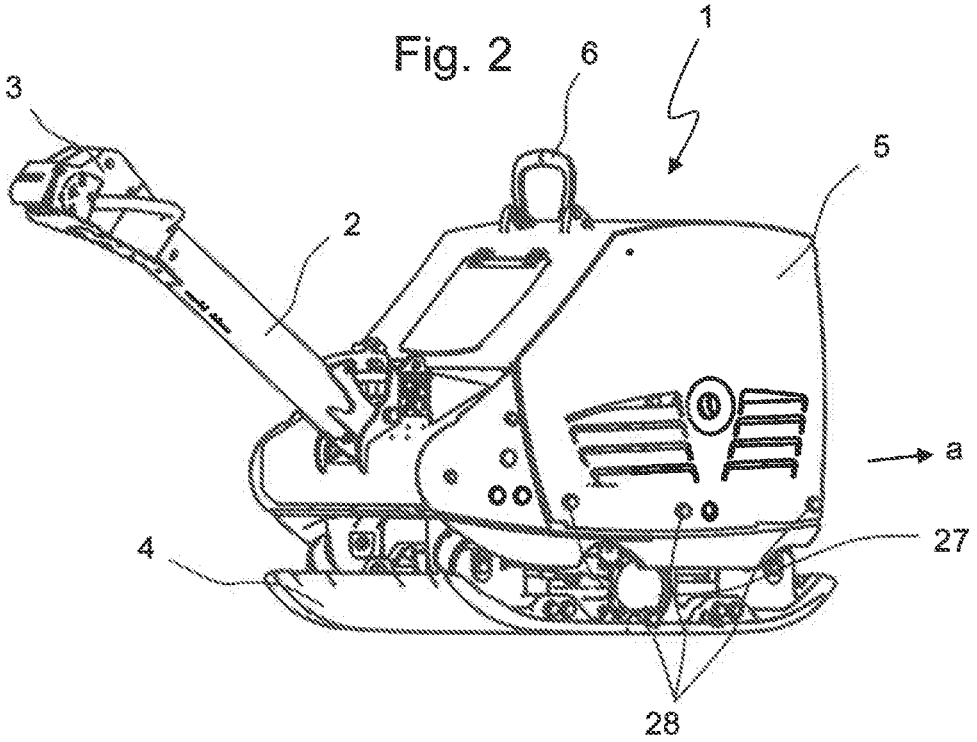
FIG. 2: is an oblique perspective rear view of a vibrating plate.

FIGS. 1 and 2 each show a generic vibrating plate 1. The vibrating plate includes a guide drawbar 2 with operating elements 3 via which an operator can control the vibrating plate 1. The guide drawbar 2 is arranged at the rear end of the vibrating plate 1 in the forward direction a. In operation, the vibrating plate 1 is guided with a base plate 4 over the soil to be compacted, either in or against the forward direction a. During this process, the base plate 4 is set in vibration by an exciter unit 27, for example an imbalance mass type vibration exciter, mounted in particular directly on the base plate. The exciter unit 27 is driven by a drive motor 9 (see FIGS. 3-7 and 12 and 13), which is typically an internal combustion engine, covered by a hood 5 in FIGS. 1 and 2. The drive motor 9 is mounted on a support plate 30 or a machine frame, which is connected to the base plate 4 via a damping element 31 in a manner known per se in the prior art. The hood 5 closes off the engine compartment from the outside and at least partially forms the outer skin of the vibrating plate 1. The hood 5 is fixedly, but detachably, attached to the support frame of the vibrating plate 1 via fasteners 28/28', in this case specifically threaded connections. Due to the fixed connection of the hood 5 to the rest of the vibrating plate 1, it can be lifted, for example, via the single-point suspension 6 and therefore easily moved on the construction site. At the same time, the hood 5 can be easily adjusted for maintenance work in the engine compartment. For this purpose, the two fasteners 28 at the rear in the forward direction a are loosened, obviously on both sides of the vibrating plate 1. The fastener 28' located at the front in the forward direction a can then be used as a swivel joint, so that the hood 5 can be swiveled forward and upward about a horizontal swivel axis S, which runs transversely to the forward direction a, in order to at least partially expose the engine compartment and in particular the drive motor 9 in this manner. The position of the hood 5 shown in FIGS. 1 and 2 corresponds to the operating position. In this position of the hood 5, the vibrating plate 1 can be operated. If, on the other hand, the hood 5 is swiveled as described above, it at least partially exposes the engine compartment and the drive motor 9 while being in the maintenance position. In this position, maintenance works can be performed inside the engine compartment. As can also be seen in FIG. 1, the side of the hood 5 located at the front in the forward direction a comprises an exhaust air opening 7 provided for the exit of the cooling air of the drive motor 9, and an exhaust gas opening 8 provided for the exit of the exhaust gases of the drive motor 9.

Figure 3:
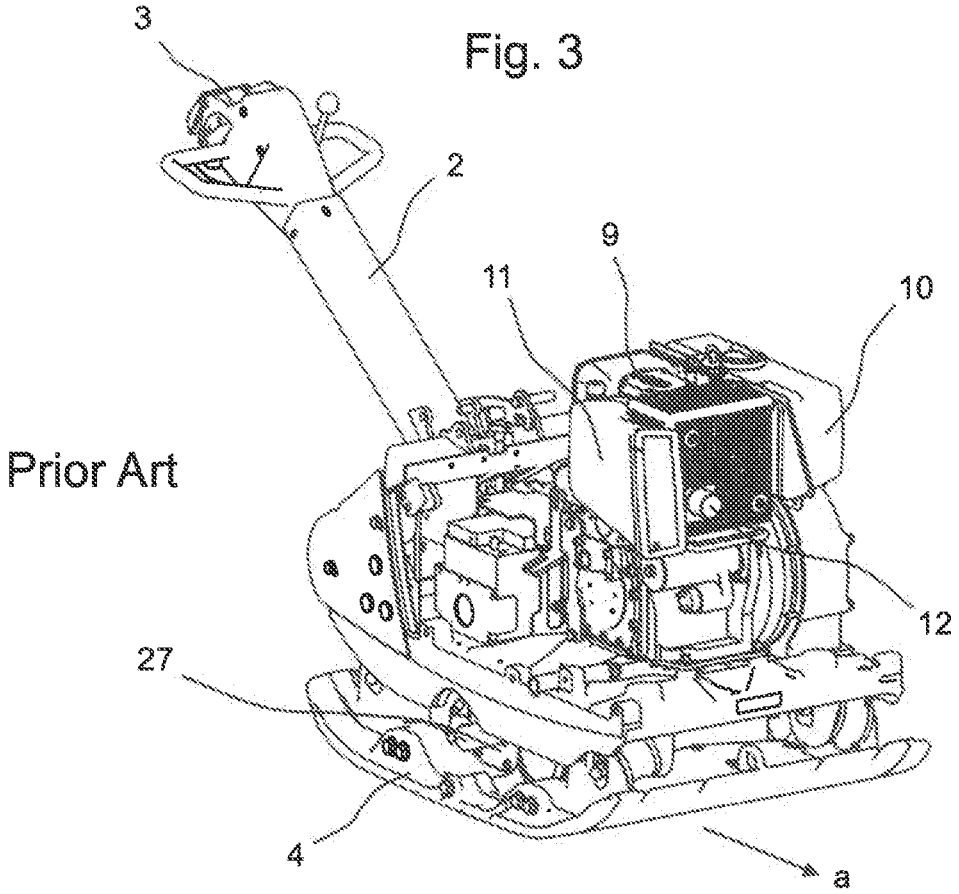
FIG. 3: is an oblique perspective front view of a prior art vibrating plate with the hood removed.
Figure 4:
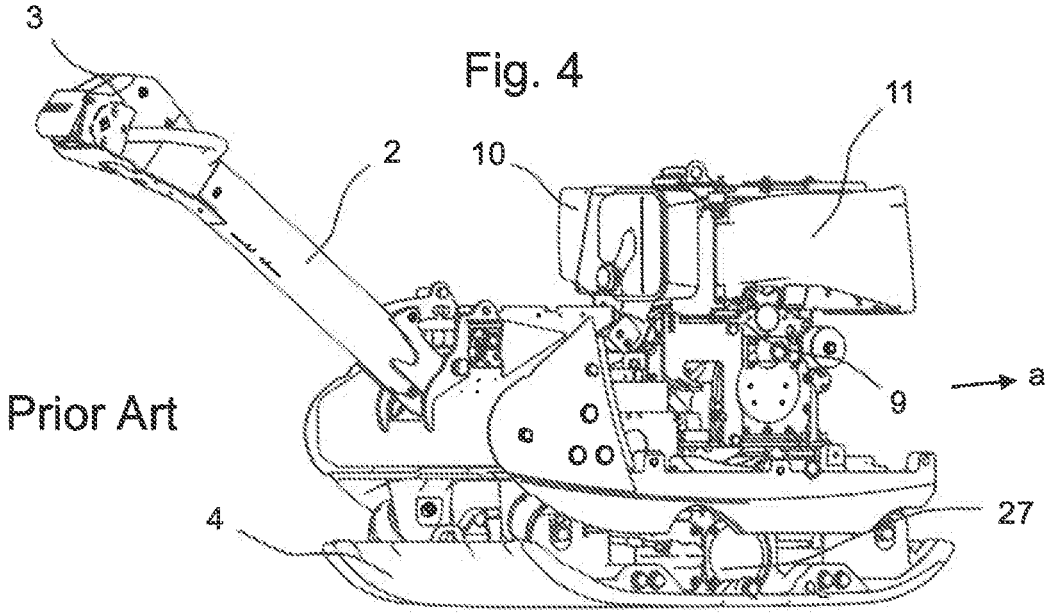
Prior Art Fig. 4
FIG. 4: is an oblique perspective rear view of a prior art vibrating plate with the hood removed.

FIGS. 3 and 4 show a prior art vibrating plate with the hood removed. As a result, both the drive motor 9 and the fuel tank 10, which are normally covered by the hood, are visible. An exhaust air duct 11 and an exhaust 12 are arranged on the drive motor 9, which are configured to direct the exhaust air and the exhaust gases of the drive motor 9 to the exhaust air opening 7 and the exhaust gas opening 8 in the hood, respectively. The exhaust air duct 11 is funnel- or trumpet-shaped and made of a plastic material, for example. Since the exhaust air duct 11 is directly attached to the drive motor 9, the structure-borne sound vibrations of the drive motor 9 are very well transmitted to the low stiffness plastic material of the exhaust air duct 11. The latter also begins to vibrate and, due to its shape, transmits the structure-borne sound of the drive motor 9 very strongly as noise emission to the outside environment. The prior art exhaust air duct 11 acts as a noise amplifier, so to speak. In addition, the exhaust air duct 11 is completely fixed at only one end, specifically at the drive motor 9. The exhaust air duct 11 must therefore not become too heavy overall, which is why it is not possible to arrange significant quantities of vibration-damping or vibration-absorbing material here. Moreover, the exhaust air duct 11 forms the entire exhaust air guiding device. Only a seal, which may be attached to the engine hood or the exhaust air duct 11, still forms an essential functional component of the entire exhaust air device. The seal prevents heated exhaust air from flowing into the space inside the hood. The present invention starts from this actual state and reduces noise emissions by making the exhaust air guiding device essentially in two parts, as described below.

Figure 5:
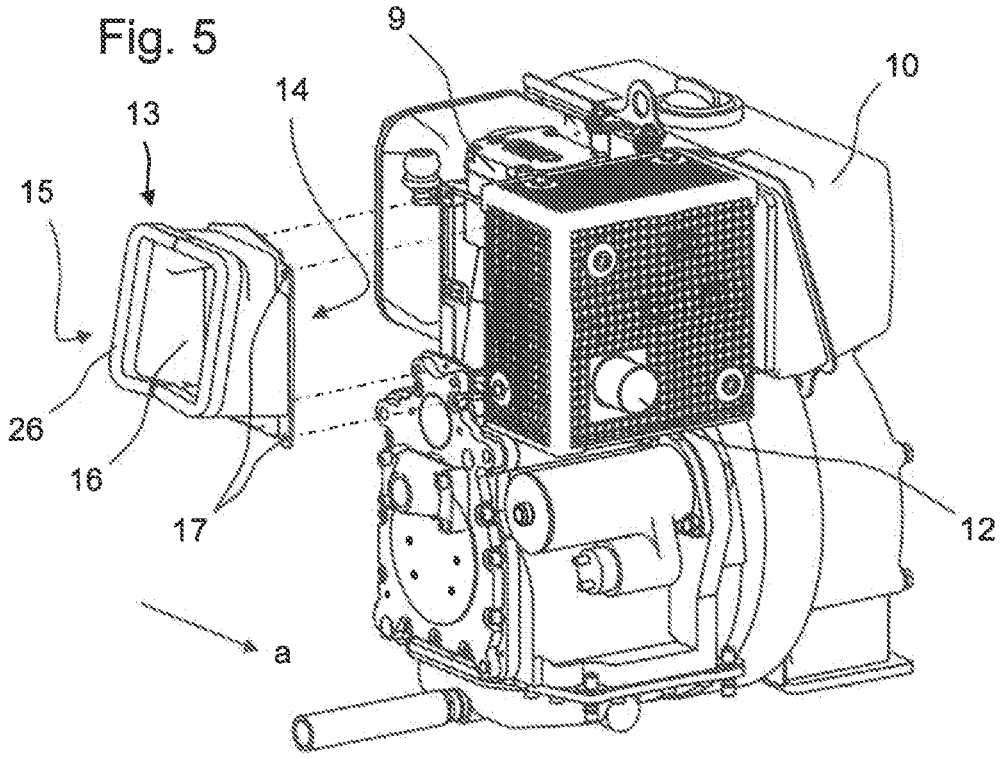
FIG. 5: is a perspective exploded view of the attachment of the exhaust air adapter to the drive motor of a vibrating plate.
Figure 6:
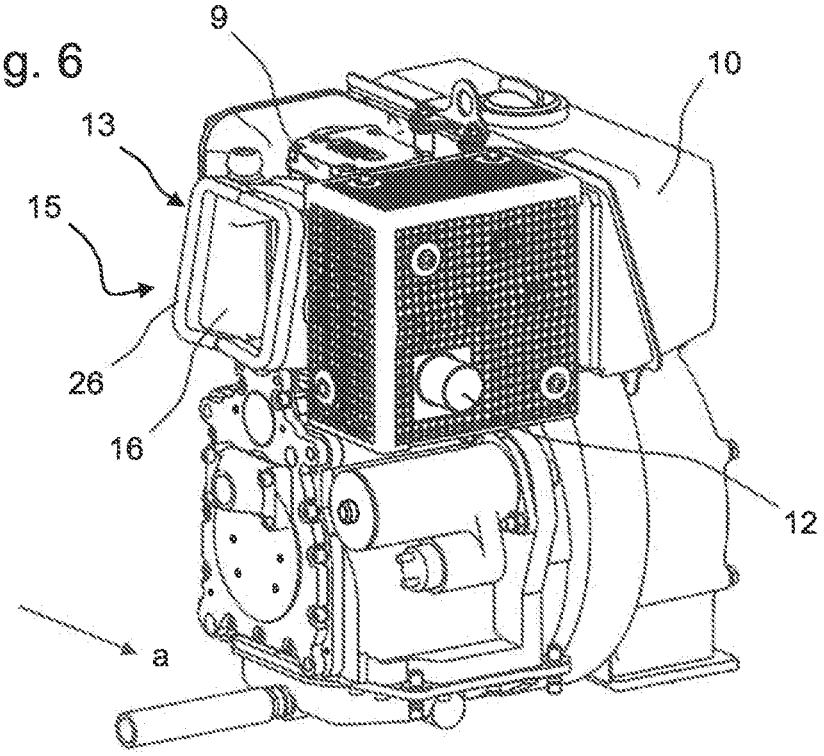
FIG. 6: shows the motor of a vibrating plate according to FIG. 5 with an exhaust air adapter mounted on the drive motor.
Figure 7:
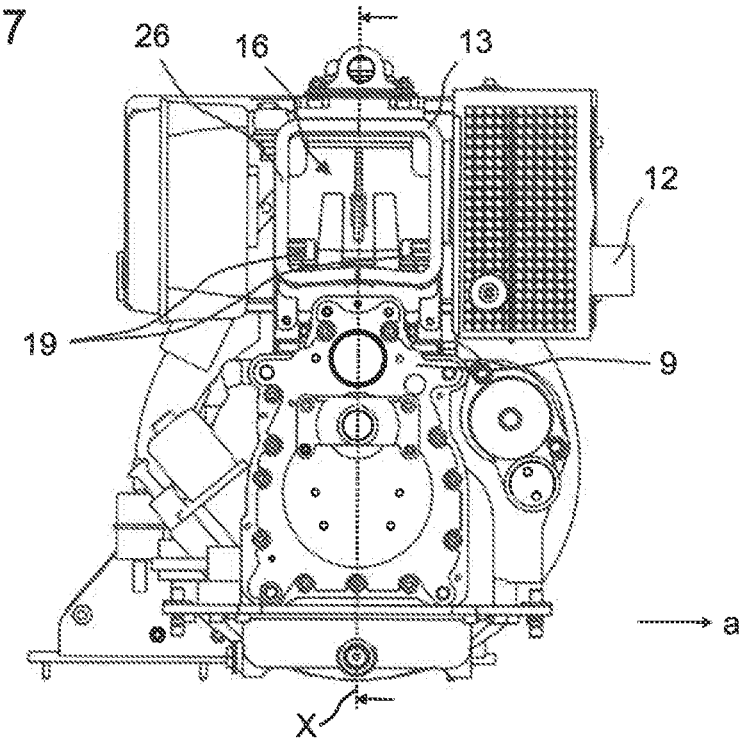
FIG. 7: is a side view of the motor according to FIG. 6.
Figure 8:
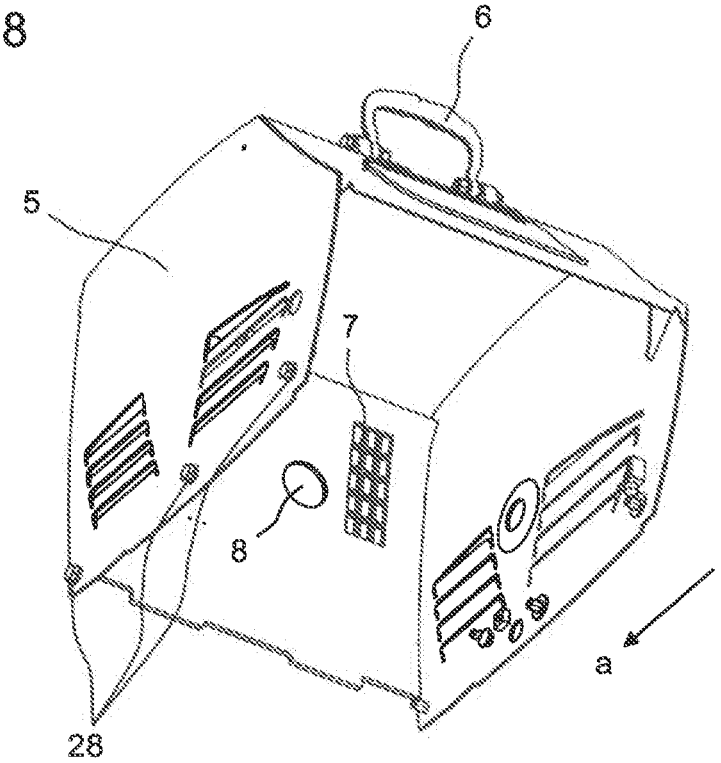
FIG. 8: is an oblique perspective rear bottom view of the hood of a vibrating plate.

FIGS. 5 to 7 show the exhaust air adapter 13 according to the invention and its arrangement on the drive motor 9. The exhaust air adapter 13 has a motor side 14 and a connection side 15. With the motor side 14, the exhaust air adapter 13 is attached to the drive motor 9, so that it receives the exhaust air coming from the drive motor 9. FIG. 7 shows that the exhaust air adapter 13 receives the exhaust air coming directly from the heat exchangers 19 of the drive motor 9, for example of the cylinder 18 (see FIG. 12). The exhaust air adapter 13 is connected to the drive motor 9 by means of fastening devices 17, for example threaded connections. Between the motor side 14 and the connection side 15, a cavity extends inside the exhaust air adapter 13, forming an exhaust air path 16. The exhaust air path 16 runs from an inlet for the exhaust air on the motor side 14 to an outlet from the exhaust air adapter 13 on the connection side 15. Overall, therefore, the exhaust air adapter 13 forms a duct for the exhaust air and directs it from the drive motor 9 to the connection side 15. The outlet for the exhaust air on the connection side 15 is furthermore equipped with a sealing element 26, for example a sealing lip. The direction of flow of the exhaust air within the exhaust air adapter 13 is essentially horizontal and perpendicular to the forward direction a. Moreover, the direction of flow of the exhaust air within the exhaust air adapter 13 is essentially perpendicular to the direction of flow of the exhaust gases in the exhaust 12, in particular in the tailpipe of the exhaust 12. The tailpipe of the exhaust 12 is oriented in particular parallel to the forward direction a.

Figure 9:
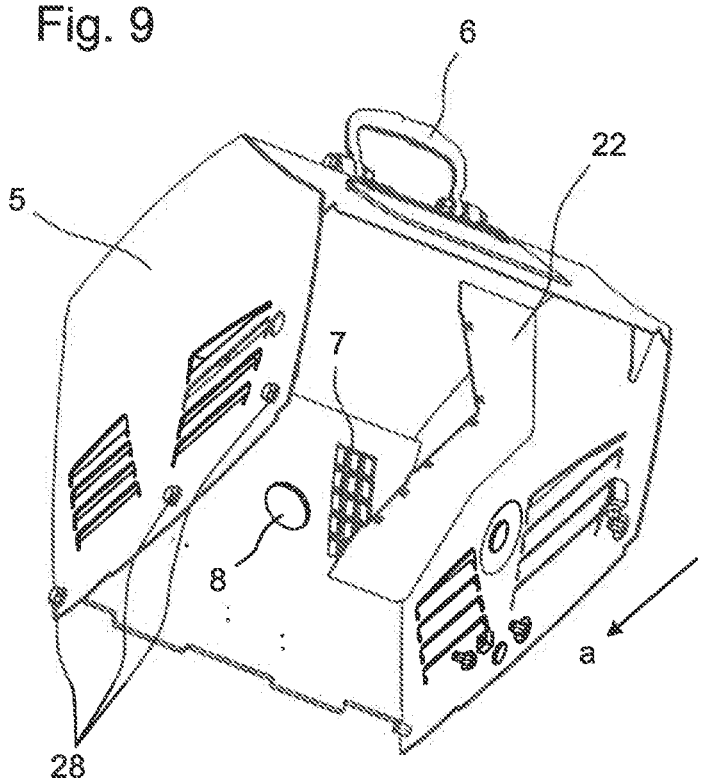
FIG. 9: is an oblique perspective rear bottom view of the hood of a vibrating plate with partially mounted exhaust air guide.
Figure 10:
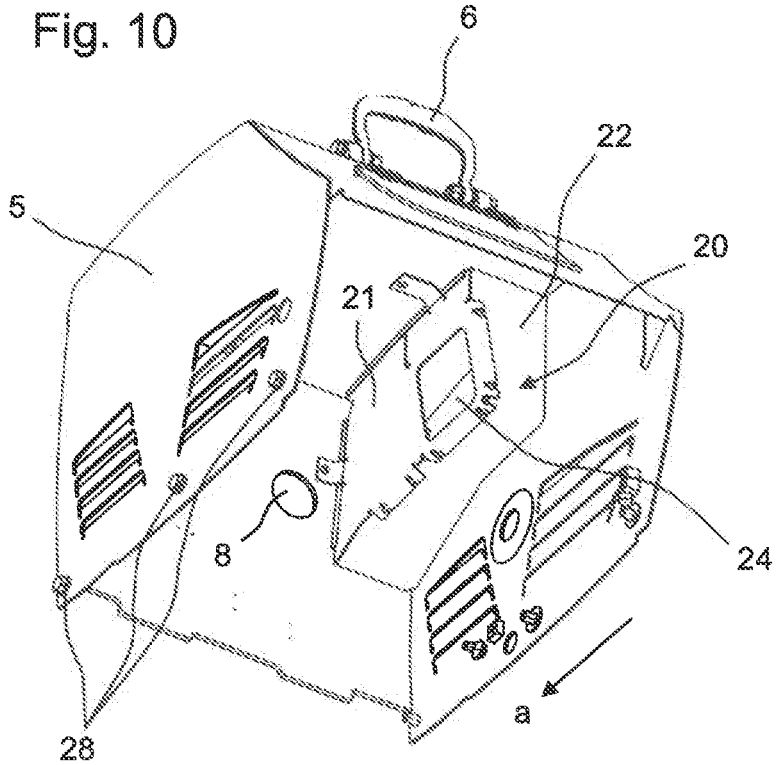
FIG. 10: is an oblique perspective rear bottom view of the hood of a vibrating plate with the exhaust air guide mounted.

FIGS. 8 to 11 show the modifications to the hood 5 according to the present invention. The view from diagonally below and from the rear as seen in the forward direction a allows a view into the interior space of the hood 5, which serves as the engine compartment when assembled. Since the exhaust air adapter 13 spans only a small part of the total air guiding path from the drive motor 9 to the exhaust air openings 7, it is proposed in accordance with the invention to bridge the remainder of the air guiding path with an exhaust air guide 20 (see FIGS. 10 and 11), which is attached to or integrated in the hood 5. The exhaust air guide 20 comprises a guiding wall 22 and an inlet wall 21. The inlet wall 21 has a connection opening 24 through which the exhaust air coming from the exhaust air adapter 13 is taken into the exhaust air guide 20. The connection opening 24 therefore forms the inlet of the exhaust air guide 20. It is complementary to the outlet of the exhaust air adapter 13 on its connection side 15. Altogether, the inlet wall 21 and the guiding wall 22 form another compartment in the interior space of the hood 5. This compartment is also formed by walls of the hood 5 itself, in the shown embodiment example specifically by the upper side of the hood 5 facing away from the base plate 4 in the mounted state and by the right side wall of the hood 5 oriented parallel to the forward direction a. The overall compartment formed by the exhaust air guide 20 in the interior of the hood 5 is essentially airtight, except for the connection to the engine compartment or the exhaust air adapter 13 via the connection opening 24 and the connection to the outside environment via the exhaust air opening 7. The latter is created by the fact that the exhaust air guide 20, which is open to the front in the forward direction a of the vibrating plate 1, tightly rests against the wall of the hood 5, which is located to the front in the forward direction a and also has the exhaust air opening 7, in such a way that the interior space of the exhaust air guide 20 communicates with the exhaust air opening 7. As shown in the sequence of FIG. 9 and FIG. 10, first the guiding wall 22 is mounted in the hood 5, the function of which is only to separate and seal the compartment of the exhaust air guide 20. Then the inlet wall 21 is mounted, both on the hood 5 and the guiding wall 22. Both the inlet wall 21 and the guiding wall 22 are formed of punched and bent metal sheets with an average thickness of 4 mm. The hood 5 is also made of such sheet metal. Overall, this results in a very stable construction, so that the interior space of the exhaust air guide 20 can be lined with a sound-damping or sound-absorbing material (see FIG. 13).

Figure 11:
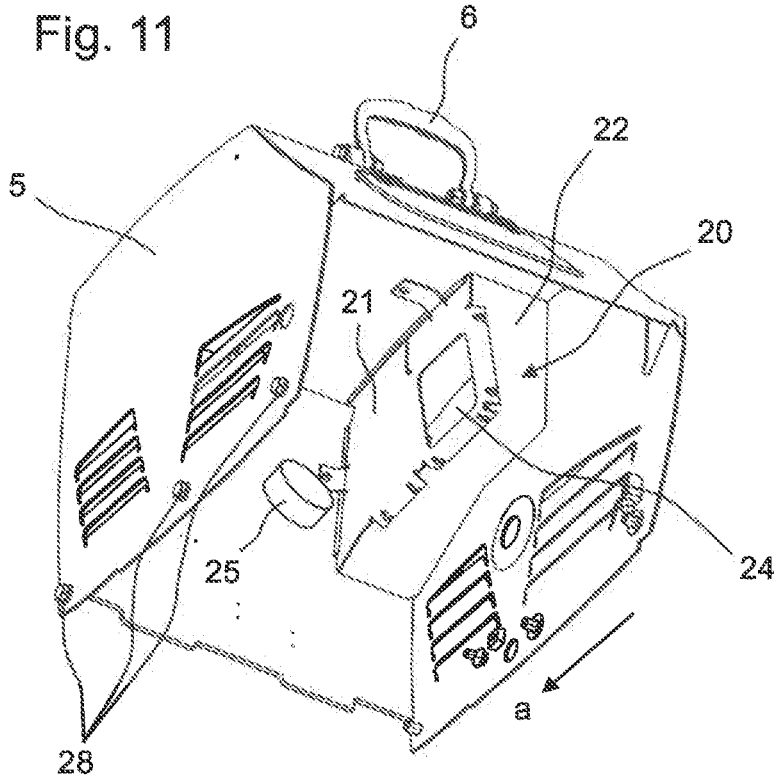
FIG. 11: is an oblique perspective rear bottom view of the hood of a vibrating plate with exhaust air guide and damping socket.

FIG. 11 moreover illustrates another aspect of the present invention. Specifically, FIG. 11 shows a damping socket 25 arranged around the exhaust gas opening 8. The damping socket 25 is designed, for example, as a pipe connection piece and has a larger diameter than the exhaust 12 of the drive motor 9. The damping socket 25 is formed and the exhaust 12 is arranged in such a way that the exhaust 12 projects into the damping socket 25 in the operating position of the hood 5. In other words, the damping socket 25 partially accommodates the exhaust 12. It is complementary in shape to the exhaust 12, and thus may take different shapes than, for example, a round tubular piece, as in the embodiment example shown. Overall, therefore, the damping socket 25 forms part of the exhaust gas guiding device and guides the exhaust gas coming from the exhaust 12 to the exhaust gas opening 8 of the hood 5. In addition, the damping socket 25 is also lined with a sound-absorbing or sound-damping material.

Figure 12:
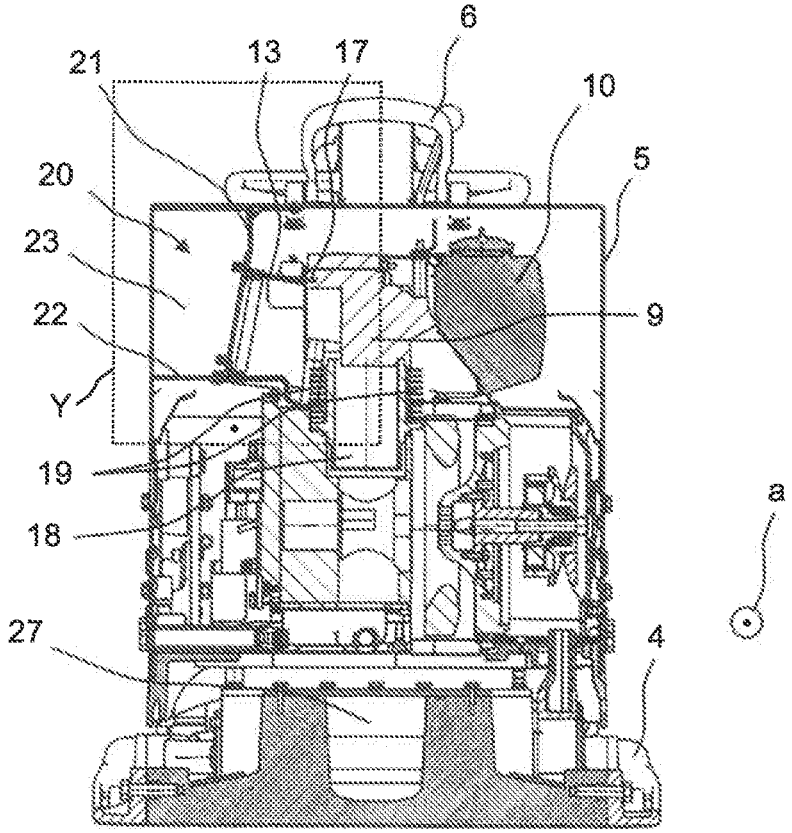
FIG. 12: shows a cross-section through a vibrating plate along the sectional plane X of FIG. 7.
Figure 13:
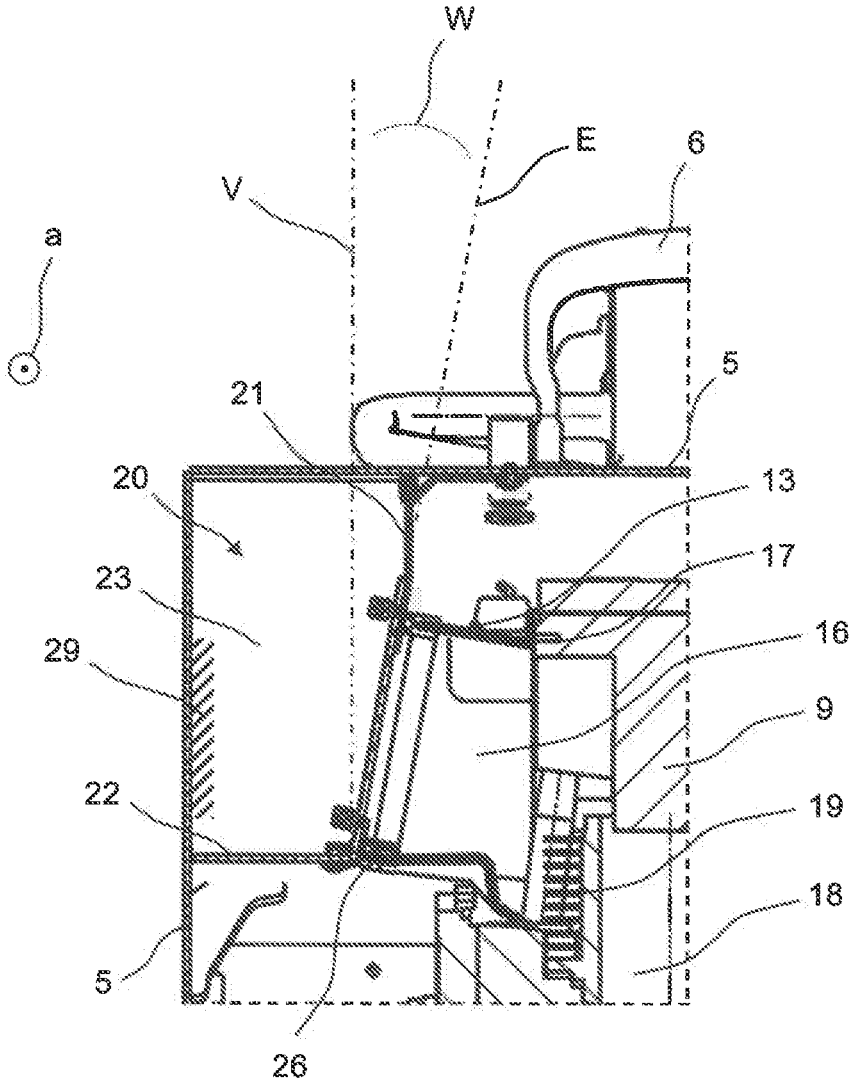
FIG. 13: is an enlarged view of cut-out section Y of FIG. 12.

FIGS. 12 and 13 show the interaction of the exhaust air adapter 13 and the exhaust air guide 20 when the hood 5 is in the operating position. For this purpose, FIG. 12 shows a cross-section through the vibrating plate 1 including the hood 5 at the level of the plane X of FIG. 7. FIG. 13 in turn shows an enlarged view of cut-out section Y of FIG. 12. The cooling air of the drive motor 9 flows around the heat exchangers 19 of the cylinder 18 and then enters the exhaust air adapter 13 as exhaust air. Here it flows through the exhaust air path 16 and enters the exhaust air guide 20 at the connection side 15 of the exhaust air adapter 13 and through the connection opening 24, where it flows through the exhaust air path 23 until it finally leaves the hood 5 at the exhaust air opening 7 and passes into the outside environment. The exhaust air guide 20 is configured such that it deflects the exhaust air flow by approximately 90°, specifically from a flow direction horizontal and perpendicular to the forward direction a to a flow direction still horizontal but parallel to the forward direction a. In the situation shown with the hood 5 in the operating position, the exhaust air adapter 13 and the exhaust air guide 20 closely rest against each other. The sealing element 26 on the exhaust air adapter 13 seals the transition of the exhaust air from the exhaust air adapter 13 into the exhaust air guide 20. The connection side 15 of the exhaust air adapter 13 and the inlet wall 21 of the exhaust air guide 20 complementary to one another. In the present embodiment example, they each lie in a plane that is parallel to plane E as shown in FIG. 13, so that they rest against each other in plane E. The plane E and thus also the connection side 15 and the inlet wall 21 form an angle W with a vertical V, which is 10°, for example. The vertical V is perpendicular to the flat main extension of the base plate 4. In other words, the connection side 15 and the inlet wall 21 are tilted by the same angle W with respect to a vertical V. In addition, the inlet wall 21 and the connection side 15 are parallel to the forward direction a. This facilitates the adjustment of the hood 5 between the maintenance position and the operating position, especially when the hood 5 is adjusted between these positions by a swivel movement as in the shown embodiment example. FIG. 13 also shows an example of a piece of sound-damping or sound-absorbing material 29 with which the entire exhaust air guide 20 is lined.

In contrast, the exhaust air guiding device according to FIGS. 3 and 4, which is formed by a single exhaust air duct 11 in the prior art, is designed in two parts according to the invention, with the larger part being fixedly arranged on the hood 5 or integrated in the hood 5. The main advantages are a better adjustability of the hood 5 between the operating position and the maintenance position, an enlargement of the part of the exhaust air guiding device fixed to the hood 5, i.e. the exhaust air guide 20, so that sound-damping material can be used. Due to the more rigid configuration of the exhaust air guide 20 compared to the exhaust air duct 11 and the structural separation from the drive motor 9, less structure-borne sound from the drive motor 9 is transmitted into a noise emission to the outside environment. In addition, the hood 5 according to the invention may be modified with a damping socket 25 that reduces noise emissions from the exhaust 12.

What is claimed is:

1. A vibrating plate for ground compaction, comprising:

a drive motor, an exciter unit driven by the drive motor, by which a base plate is settable in vibration, an adjustably mounted hood which is adjustable between an operating position at least partially covering the drive motor and a maintenance position at least partially exposing the drive motor, an exhaust air guiding device leading from the drive motor to an exhaust air opening in the hood for cooling air of the drive motor, wherein the exhaust air guiding device is configured in at least two parts and comprises an exhaust air adapter on a drive motor side and an exhaust air guide on a hood side, the exhaust air adapter and the exhaust air guide together forming a continuous exhaust air path from the drive motor to the exhaust air opening in the hood when the hood is in the operating position, wherein the exhaust air adapter is attached to the drive motor, wherein the exhaust air guide is attached to the hood such that the exhaust air guide is adjustable with the hood between the operating position and the maintenance position, and wherein both the exhaust air adapter and the exhaust air guide each represent a duct section conducting the exhaust air flow, wherein the two duct sections merge in the operating position.

2. The vibrating plate according to claim 1, wherein:

the exhaust air guide forms at least 30% of a total air guiding path through the exhaust air guiding device between the drive motor and the exhaust air opening.

3. The vibrating plate according to claim 1, wherein:

a volume of the exhaust air guiding device within the exhaust air guide is larger than a volume of the exhaust air guiding device within the exhaust air adapter.

4. The vibrating plate according to claim 1, wherein:

the exhaust air guide on the hood side is configured such that the exhaust air guide changes a flow direction of exhaust air between the drive motor and the exhaust air opening at least once by essentially 90°.

5. The vibrating plate according to claim 1, wherein:

the exhaust air adapter has a motor side to connect to the drive motor and a connection side to connect to the exhaust air guide, and the connection side comprises an elastic sealing element which rests against the exhaust air guide when the hood is in the operating position.

6. The vibrating plate according to claim 5, wherein:

the connection side of the exhaust air adapter is tilted with respect to a vertical by an angle in a range of 5° to 15°.

7. The vibrating plate according to claim 1, wherein:

the exhaust air guide has an inlet wall and a guiding wall, the inlet wall having a connection opening through which exhaust air coming from the exhaust air adapter enters the exhaust air guide, and the inlet wall and the guiding wall being configured as separate components which are mounted successively.

8. The vibrating plate according to claim 7, wherein:

the inlet wall of the exhaust air guide is tilted with respect to a vertical (V) by an angle (W) in a range of 5° to 15°.

9. The vibrating plate according to claim 7, wherein:

the guiding wall is arranged essentially at a right angle to at least one wall of the hood and is attached to the hood.

10. The vibrating plate according to claim 7, wherein:

the inlet wall and the guiding wall are bent from flat blanks.

11. The vibrating plate according to claim 7, wherein:

the inlet wall and/or the guiding wall is/are at least partially made of a same material as the hood.

12. The vibrating plate according to claim 1, wherein:

the exhaust air guide is formed on at least one side by one or more walls of the hood.

13. The vibrating plate according to claim 1, wherein:

the exhaust air guide at least partially has a lining with a sound-damping or a sound-absorbing material.

14. The vibrating plate according to claim 1, wherein:

the vibrating plate comprises an exhaust gas guiding device from an exhaust of the drive motor to an exhaust gas opening in the hood, and the hood comprises a damping socket (25) arranged on the hood such that the damping socket is adjustable with the hood between the operating position and the maintenance position, and which is configured to guide exhaust gas from the exhaust to the exhaust gas opening, the damping socket at least partially engaging around the exhaust of the drive motor in the operating position of the hood.

15. The vibrating plate according to claim 14, wherein:

the damping socket at least partially has a lining with a sound-damping or a sound-absorbing material.

16. The vibrating plate according to claim 2, wherein:

the exhaust air guide forms at least 50% of the total air guiding path through the exhaust air guiding device between the drive motor and the exhaust air opening.

17. The vibrating plate according to claim 3, wherein:

the volume of the exhaust air guiding device within the exhaust air guide is at least two times larger than the volume of the exhaust air guiding device within the exhaust air adapter.

18. The vibrating plate according to claim 1, wherein:

the exhaust air adapter has a connection side to connect to the exhaust air guide, and the connection side of the exhaust air adapter is tilted with respect to a vertical by an angle in a range of 5° to 15°, and the exhaust air guide has an inlet wall having a connection opening through which exhaust air coming from the exhaust air adapter enters the exhaust guide, and the inlet wall of the exhaust air guide is tilted with respect to the vertical by the angle in the range of 5° to 15°.

19. The vibrating plate according to claim 13, wherein:

the sound-damping or the sound-absorbing material comprises at least one of a plastic foam and a non-woven fabric.

20. The vibrating plate according to claim 15, wherein:

the sound-damping or the sound-absorbing material comprises at least one of a plastic foam and a non-woven fabric.

* * * * *